US007331903B2

(12) United States Patent
Nissen et al.

(10) Patent No.: US 7,331,903 B2
(45) Date of Patent: Feb. 19, 2008

(54) TRAMPOLINE HAVING A CURVED FRAME WITH BETTER JUMPING CHARACTERISTICS

(75) Inventors: George Nissen, San Diego, CA (US); Masato Ikegami, Fuchu (JP)

(73) Assignee: FUNTEK USA, Inc., San Diego, CA (US)

( * ) Notice: Subject to any disclaimer, the term of this patent is extended or adjusted under 35 U.S.C. 154(b) by 619 days.

(21) Appl. No.: 10/634,340

(22) Filed: Aug. 4, 2003

(65) Prior Publication Data

US 2005/0032609 A1 Feb. 10, 2005

(51) Int. Cl.
*A63B 5/11* (2006.01)
*A47C 19/04* (2006.01)

(52) U.S. Cl. ..... 482/27; 5/111

(58) Field of Classification Search ..... 482/27–29; 182/138–140; D21/797; 5/110–112
See application file for complete search history.

(56) References Cited

U.S. PATENT DOCUMENTS

| | | | | |
|---|---|---|---|---|
| 810,615 | A * | 1/1906 | Butler | 182/138 |
| 2,799,867 | A * | 7/1957 | Fenner et al. | 482/28 |
| 3,031,688 | A * | 5/1962 | Southwood | 5/120 |
| 3,201,123 | A | 8/1965 | Nissen | |
| 3,501,141 | A | 3/1970 | Nissen | |
| 3,580,570 | A * | 5/1971 | Fenner et al. | 482/28 |
| 3,767,192 | A * | 10/1973 | Eriksson | 482/27 |
| 3,983,585 | A | 10/1976 | Sidlinger | |
| 4,284,271 | A * | 8/1981 | Pettit et al. | 482/27 |

(Continued)

FOREIGN PATENT DOCUMENTS

FR 2684882 6/1993

OTHER PUBLICATIONS

European Search Report, European Patent Office. Oct. 28, 2004.

(Continued)

*Primary Examiner*—Fenn C. Mathew
(74) *Attorney, Agent, or Firm*—Steven G. Roeder; James P. Broder

(57) ABSTRACT

A trampoline (10) includes a base frame (14) having a substantially non-rectangular perimeter region (38), a bed suspension assembly (16) and a bed (12). The bed (12) is coupled to the base frame (14) with the bed suspension assembly (16). Further, the bed (12) includes a first pair of substantially parallel sides (34A, 34B). For example, the bed (12) can be rectangular in shape, or can include a second pair of arc-shaped sides (36A, 36B). The perimeter region (38) can be substantially oval-shaped or circular-shaped. The trampoline (10) can also include one or more side sections (18, 22) and one or more side suspensions (20, 24) that couple the side sections (18, 22) to the base frame (14). In one embodiment, the side sections (18, 22) each include an inner side (54, 58) that is substantially linear and an outer side (56, 60) that is substantially arc-shaped. Additionally, the trampoline (10) can include one or more end sections (26, 30) and one or more end suspensions (28, 32) that couple the end sections (26, 30) to the base frame (14). In one embodiment, the end sections (26, 30) each have inner sides (64, 68) that are substantially linear and outer sides (66, 70) that are substantially arc-shaped.

24 Claims, 6 Drawing Sheets

U.S. PATENT DOCUMENTS

| | | | | | |
|---|---|---|---|---|---|
| 4,331,329 | A | * | 5/1982 | Mirkovich et al. | 482/27 |
| 4,341,379 | A | * | 7/1982 | Milligan | 482/28 |
| 4,386,772 | A | * | 6/1983 | Wu | 482/28 |
| 4,478,420 | A | | 10/1984 | Sowards | |
| D287,909 | S | * | 1/1987 | Weiss | D6/329 |
| 5,711,743 | A | | 1/1998 | Nichols, Jr. et al. | |
| 5,941,798 | A | | 8/1999 | Coan et al. | |
| 6,053,845 | A | | 4/2000 | Publicover et al. | |
| 6,135,922 | A | | 10/2000 | Nissen | |
| 6,539,564 | B1 | * | 4/2003 | Hsia | 5/110 |
| 2003/0013559 | A1 | | 1/2003 | Gordon | |

OTHER PUBLICATIONS

JumpSport™ Home Page, *Trampoline Court™*, 1 page, dated Dec. 15, 1997. http://www.jumpsport.com/.

JumpSport™ brochure on the *Trampoline Court™*, Safety Enclosure System, 2 pages, not dated.

*Ultimate Basketball Experience*, Spaceball, Ltd. 6914 Rockingham Dr., SW Cedar Rapids, IA, 52404, 1 page, © JumpShot 1997.

Spaceball ©color brochure, 2 pages, not dated.

Spaceball © illustrated by Echo Fox, Patent Applied for 1981.

Brochure on Spaceball, *Spaceball is played everywhere* . . . , 1 page, not dated.

Crochure on *General Rules and Spaceball Scoring* . . . , Nissen Corporation, 930 27th Ave., S.W., Cedar Rapids, Iowa, not dated.

Advertising materials with illustrations on Nissen Spaceball, 2 pages, not dated.

* cited by examiner

TRAMPOLINE HAVING A CURVED FRAME WITH BETTER JUMPING CHARACTERISTICS

FIELD OF THE INVENTION

The present invention pertains to an improved trampoline.

BACKGROUND

Currently, trampolines have either a rectangular or round shape. Rectangular trampolines include rectangular beds that are supported by rectangular frames having four sides. In contrast, round trampolines include round beds that are supported by round frames.

Rectangular trampolines historically were found to be more appropriate for acrobatic and competitive use because the rectangular bed provides better orientation for the users and provides better jumping characteristics. However, the rectangular frames used in rectangular trampolines need to be relatively thick to inhibit bending of the sides and normally require at least some structural supports that extend between the sides to inhibit bending of the sides. These structural supports are typically positioned directly below the bed of the trampoline. As a result, the frame is quite heavy and the bed of a rectangular trampoline needs to be raised higher above a support surface, i.e. the ground or a floor, to accommodate the structural supports. Moreover, in order to obtain the required structural rigidity of the rectangular frame, each of the sides is typically made as a thick, heavy, unitary structure. This increases the cost to manufacture, pack and ship the components of a rectangular-framed trampoline. Additionally, rectangular frames are typically not as stable as round frames, which can tend to be less conducive to sway or wobble.

In contrast, because of the curved shape, the round frame of the round trampoline does not have to be as thick and heavy. Further, the round frame can be made in a plurality of individual curved segments. As a result thereof, the cost to manufacture, pack and ship the components of a round trampoline is typically much less than that of a rectangular trampoline. Unfortunately, round trampolines are also not considered to be entirely satisfactory. Round trampolines can tend to cause a participant to lose orientation because there are no reference points for the user to ascertain his or her bearings, as there are when using a rectangular trampoline. Further, many competitors do not like the jumping characteristics of the round bed of the round trampoline.

In view of the above, a need exists to provide a trampoline that allows a user to maintain sufficient orientation without a decrease in stability of the frame. A further need exists to provide a trampoline that has an aesthetically pleasing appearance which is simplistic in design, is easy to assemble, relatively simple and economical to manufacture, and which includes a framework having a relatively sturdy superstructure, without compromising user orientation during trampolining.

SUMMARY

A trampoline in accordance with the present invention includes a base frame having a substantially non-rectangular perimeter region, a bed suspension assembly and a bed. The bed is coupled to the base frame with the bed suspension assembly. The trampoline provided herein can include a partially or entirely curved base frame that supports a substantially rectangular bed or a bed having a first pair of substantially parallel sides. With this design, in one embodiment, the trampoline combines the structural benefits of a substantially round frame while also providing the jumping characteristics and orientation to the user of a rectangular bed, or a bed having at least one pair of parallel sides. As used herein, a "round" trampoline frame can include circular, oval or otherwise curved frames. In one embodiment, the bed includes a second pair of substantially parallel sides. In an alternative embodiment, the bed includes a second pair of sides that are arc-shaped. Additionally, the perimeter region of the base frame is substantially non-rectangular. For example, the perimeter region can be substantially oval-shaped or circular-shaped.

The trampoline can also include a first side section and a first side suspension that couples the first side section to the base frame. In one embodiment, the first side section includes a first inner side that is substantially linear and a first outer side that is substantially arc-shaped. The trampoline can also include a second side section and a second side suspension that couples the second side section to the base frame. In this embodiment, the second side section can have a second inner side that is substantially linear and a second outer side that is substantially arc-shaped. Further, the bed can be positioned substantially between the first side section and the second side section.

In another embodiment, the first side suspension includes a plurality of resilient members that support the first side section. The second side suspension includes a plurality of resilient members that support the second side section. Additionally, the trampoline can include a first end section and a first end suspension that couples the first end section to the base frame. The trampoline can also include a second end section and a second end suspension that couples the second end section to the base frame. In one embodiment, the end sections each have inner sides that are substantially linear and outer sides that are substantially arc-shaped.

The trampolines described herein have one or more of the following advantages: the substantially round base frame eliminates the need for a standard rectangular base frame that is positioned at least partially under the bed, and thus can result in lowering the bed closer to the support surface. The base frame provided herein can make use of existing modular economic features of the round base frame in fabricating, storing, assembling and/or shipping. The trampoline can result in taking up approximately the same amount of space as a conventional round trampoline. The rectangular bed has many or all of the same performance advantages of a conventional, rectangular bed on a rectangular base frame. One or more of the trampolines described herein provide substantially flat side and end sections between the perimeter region and the interior region of the base frame, which allow participants to get on and off the trampoline bed more efficiently and easily. These sections are conducive to standing, coaching, spotting and/or controlling accessibility to the bed of the trampoline. Moreover, the trampoline, when equipped with one or more backstops, forms a spaceball court.

The present invention also includes a method for manufacturing a trampoline.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
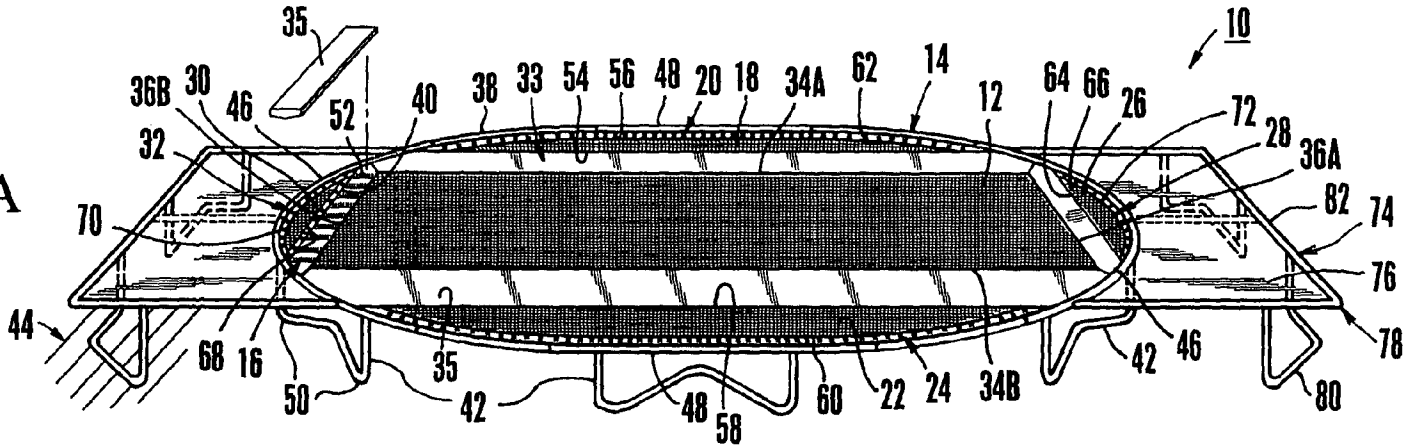
FIG. 1A is a partially exploded, perspective view of an embodiment of a trampoline having features of the present invention.

FIG. 1A is a perspective view of an embodiment of a trampoline 10 having features of the present invention. In this embodiment, the trampoline includes a bed 12, a base frame 14, a bed suspension assembly 16, a first side section 18, a first side suspension 20, a second side section 22, a second side suspension 24, a first end section 26, a first end suspension 28, a second end section 30, a second end suspension 32 and a pad assembly 33. The bed suspension assembly 16 attaches the bed 12 to the base frame 14. The attachment of the bed 12 to the base frame 14 places the bed 12 in tension.

The design of the bed 12 can vary depending upon the design requirements of the trampoline 10 and the base frame 14. In the embodiment illustrated in FIG. 1A, the bed 12 is basically rectangular in shape. Stated another way, the bed 12 includes a pair of substantially parallel first sides 34A, 34B and a pair of substantially parallel second sides 36A, 36B. In one embodiment, each first side 34A, 34B is approximately two times the length of each second side 36A, 36B. For example, a competition trampoline 10 can include a bed 12 with each first side 34A, 34B being approximately 14 feet in length and each second side 36A, 36B being approximately 7 feet in length. However, the length of each of the sides 34A, 34B, 36A, 36B can be greater or less than these dimensions. Moreover, as explained below, the shape of the bed 12 can be square, or can otherwise deviate from that of a rectangle.

The design of the base frame 14 can be varied to suit the design requirements of the trampoline 10, the bed 12 and/or the bed suspension assembly 16. In the embodiment illustrated in FIG. 1A, the base frame 14 includes a perimeter region 38, an interior region 40 and a plurality of legs 42 that support the perimeter region 38 above a support surface 44. In this embodiment, the perimeter region 38 of the base frame 14 is somewhat oval-shaped. The percentage of the total perimeter region 38 that is curved can vary. In alternative embodiments, the percentage of the perimeter region 38 that is curved is at least approximately 25 percent, 40 percent, 50 percent, 60 percent, 70 percent, 80 percent, 90 percent, 95 percent or 100 percent of the total length of the perimeter region 38.

Further, the perimeter region 38 can include a plurality of sections that can be secured together to form the perimeter region 38. With this modular-type design, shipping and disassembly for storage of the base frame 14 is facilitated. Alternatively, the perimeter region 38 can be formed as a unitary structure. In one embodiment, the perimeter region 38 includes two U-shaped sections 46 and two connector sections 48 that connect the U-shaped sections 46 together. Each U-shaped section 46 can be formed as a unitary structure, or can be formed from two or more separate sections that are secured together. In one embodiment, each U-shaped section 46 is substantially semi-circular in shape. Alternatively, each U-shaped section 46 can be parabolic, arcuate shaped, or can have another suitable configuration.

The connector sections 48 can be substantially linear or non-linear. Alternatively, the connector sections 48 can include both linear and non-linear sections. In one embodiment, for example, each connector section 48 is substantially linear, and is approximately five feet, five inches in length. However, any suitable configuration for the connector sections 48 can be utilized with the present invention.

In the embodiment illustrated in FIG. 1A, the interior region 40 resembles the general shape of the bed 12. For example, in this embodiment, the interior region 40 of the base frame 14 is somewhat rectangular-shaped. With this design, the bed suspension assembly 16 can include similarly sized and shaped components, as described below. Alternatively, the interior region 40 of the base frame 14 can have a generally different configuration than that of the bed 12.

As illustrated in FIG. 1A, the legs 42 of the base frame 14 can directly (or indirectly) support the perimeter region 38 and/or the interior region 40 above the support surface 44, such as a floor or the ground. The configuration of the legs 42 and the number of legs 42 can vary. In one embodiment, the base frame 14 can include five legs 42, although greater or fewer than five legs 42 can be included in the base frame 14. The legs 42 are spaced apart, and are coupled to the perimeter region 38 of the base frame 14. In this embodiment, each leg 42 can be somewhat W-shaped for rigidity and strength. Further, each leg 42 has one or more contact points 50 with the support surface 44 for increased stability. Alternatively, the legs 42 can have a different configuration provided the requisite stability and rigidity is maintained. Moreover, because the base frame 14 illustrated in FIG. 1A does not include structural members that are positioned directly between the bed 12 and the support surface 44, the height of the base frame 14, and thus the bed 12, above the support surface 44 can be reduced.

Further, the base frame 14 can be formed from various materials such as metal, wood, plastic, composite materials, ceramic or any other suitably rigid materials. Alternatively, a combination of such materials can be used.

As illustrated in FIG. 1A, the bed suspension assembly 16 can include a plurality of resilient members 52. For example, each resilient member 52 can include a spring, elastic, plastic, rubber or another suitably resilient structure. The size and number of resilient members 52 can vary. For example, in one embodiment, the bed suspension assembly 16 can include approximately 118 similarly-sized extension springs having a one-inch diameter, with each spring being formed from 12 gauge steel. However, greater or fewer than 118 springs having various dimensions can be used.

In the embodiment illustrated in FIG. 1A, the first side section 18 and the second side section 22 are basically mirror images of each other. The design of and dimensions each side section 18, 22 can vary to suit the design requirements of the trampoline 10. The side sections 18, 22 can be made from a similar material as the bed 12, i.e. canvas, nylon or other plastics, as non-exclusive examples. Alternatively, the side sections 18, 22 can be made from non-resilient materials, such as rigid plastics, wood, metal, or other suitable materials. In this embodiment, the side sections 18, 22 are somewhat D-shaped, and are positioned so that the bed 12 is located substantially between the first side section 18 and the second side section 22. Alternatively, however, the side sections 18, 22 can have a different shape, such as rectangular, oval, square, trapezoidal, or another suitable geometry.

The first side section 18 includes a first inner side 54 and a first outer side 56. The first inner side 54 is positioned somewhat adjacent to one of the first sides 34A of the bed 12. The first outer side 56 is positioned adjacent to a portion of the perimeter region 38 of the base frame 14.

The second side section 22 includes a second inner side 58 and a second outer side 60. The second inner side 58 is positioned somewhat adjacent to the other first side 34B of the bed 12. The second outer side 60 is positioned adjacent to a portion of the adjacent perimeter region 38 of the base frame 14. In one embodiment, the inner sides 54, 58 are parallel to the first sides 34A, 34B of the bed 12. Further, the outer sides 56, 60 have a shape that follows a contour of a portion of the perimeter region 38 of the base frame 14. In alternative embodiments, one or more of the inner sides 54, 58 and/or the outer sides 56, 60 can have a different configuration.

The first side suspension 20 supports the first side section 18. The first side suspension 20 illustrated in FIG. 1A includes a plurality of resilient members 62 that couple the first side section 18 to a portion of the interior region 40 and a portion of the perimeter region 38 of base frame 14.

Somewhat similarly, the second side suspension 24 supports the second side section 22. The second side suspension 24 illustrated in FIG. 1A includes a plurality of resilient members 62 that couple the second side section 22 to a portion of the interior region 40 and a portion of the perimeter region 38 of base frame 14. The size and number of resilient members 62 of the side suspensions 20, 24 can vary. In one embodiment, the resilient members 62 of the side suspensions 20, 24 are smaller than the resilient members 52 of the bed suspension assembly 16. However, in alternative embodiments, the size of the resilient members 62 of the side suspensions 20, 24 can be the same as or larger than the resilient members 52 of the bed suspension assembly 16.

In the embodiment illustrated in FIG. 1A, the first end section 26 and the second end section 30 are basically mirror images of each other. The design of and dimensions of each end section 26, 30 can vary to suit the design requirements of the trampoline 10. The end sections 26, 30 can be made from a similar material as the bed 12, i.e. a resilient material such as canvas, nylon or other plastics, as non-exclusive examples. Alternatively, the end sections 26, 30 can be made from non-resilient materials, such as rigid plastics, wood, metal, or other suitable materials. In this embodiment, the end sections 26, 30 are somewhat D-shaped, and are positioned so that the bed 12 is located substantially between the first end section 26 and the second end section 30. Alternatively, the end sections 26, 30 can have a different shape, such as rectangular, oval, square, trapezoidal, or another suitable geometry.

In this embodiment, the first end section 26 includes a first inner side 64 and a first outer side 66. The first inner side 64 of the first end section 26 is positioned somewhat adjacent to one of the second sides 36A of the bed 12. The first outer side 66 of the first end section 26 is positioned adjacent to a portion of the perimeter region 38 of the base frame 14.

Moreover, the second end section 30 includes a second inner side 68 and a second outer side 70. The second inner side 68 is positioned somewhat adjacent to the other of the second side 36B of the bed 12. The second outer side 70 is positioned adjacent to a portion of the perimeter region 38 of the base frame 14. In this embodiment, the inner sides 64, 68 are parallel to the second sides 36A, 36B of the bed 12. Further, the outer sides 66, 70 have a shape that follows a contour of a portion of the adjacent perimeter region 38 of the base frame 14. In alternative embodiments, one or more of the inner sides 64, 68 and/or the outer sides 66, 70 can have a different configuration.

The first end suspension 28 supports the first end section 26. The first end suspension 28 illustrated in FIG. 1A includes a plurality of resilient members 72 that couple the first end section 26 to a portion of the interior region 40 and a portion of the perimeter region 38 of base frame 14.

Somewhat similarly, the second end suspension 32 supports the second end section 30. The second end suspension 32 illustrated in FIG. 1A includes a plurality of resilient members 72 that couple the second end section 30 to a portion of the interior region 40 and a portion of the perimeter region 38 of base frame 14. The size and number of resilient members 72 of the end suspensions 28, 32 can vary. In one embodiment, the resilient members 72 of the end suspensions 28, 32 are smaller than the resilient members 52 of the bed suspension assembly 16. However, in alternative embodiments, the size of the resilient members 72 of the end suspensions 28, 32 can be the same as or larger than the resilient members 52 of the bed suspension assembly 16.

The pad assembly 33 helps to protect the user from injury. In this embodiment, the pad assembly 33 includes one or more pads 35 (one of the pads 35 is shown in an exploded view for clarity) that substantially cover at least a portion of the bed suspension assembly 16 and/or a portion of one or more of the side suspensions 20, 24 and/or the end suspensions 28, 32. In FIG. 1A, the pad assembly 33 includes four pads 35 that substantially cover at least a portion of the resilient members 52 of the bed suspension assembly 16, and a portion of resilient members 62, 72 of the side suspensions 20, 24, and the end suspensions 28, 32 that are adjacent to the resilient members 52 of the bed suspension assembly. The dimensions of the pads 35 can vary. The pads 35 can be formed from materials such as various foam plastics or spongy materials, and can have a nylon or other suitable, pliable protective covering.

The trampoline 10 can also include one or more extension sections 74, as illustrated in FIG. 1A. In this embodiment, one extension section 74 cantilevers from each end of the perimeter region 38 of the base frame 14. The extension sections 74 can have a basic geometry that is generally rectangular, arcuate, trapezoidal, or another suitable configuration. Each extension section 74 can include a substantially planar platform 76 and an extension frame 78 that supports the platform 76. The platform 76 can be formed from relatively pliable materials such as canvas, nylon or other soft plastics, or from relatively rigid materials such as wood, metal, or hard plastics, as non-exclusive examples.

The extension frame 78 can include one or more extension legs 80 and a platform support 82. The extension frame 78 can be formed from relatively rigid materials such as wood or metal as non-exclusive examples. In the embodiment illustrated in FIG. 1A, the platform support 82 of each extension section 74 is supported by two somewhat W-shaped extension legs 80, although the shape of the extension legs 80 can be varied. Each platform support 82 supports one of the platforms 76. The extension sections 74 can have sufficient strength and rigidity to allow a user to stand on the platform 76 without compromising the stability of the trampoline 10.

Figure 1B:
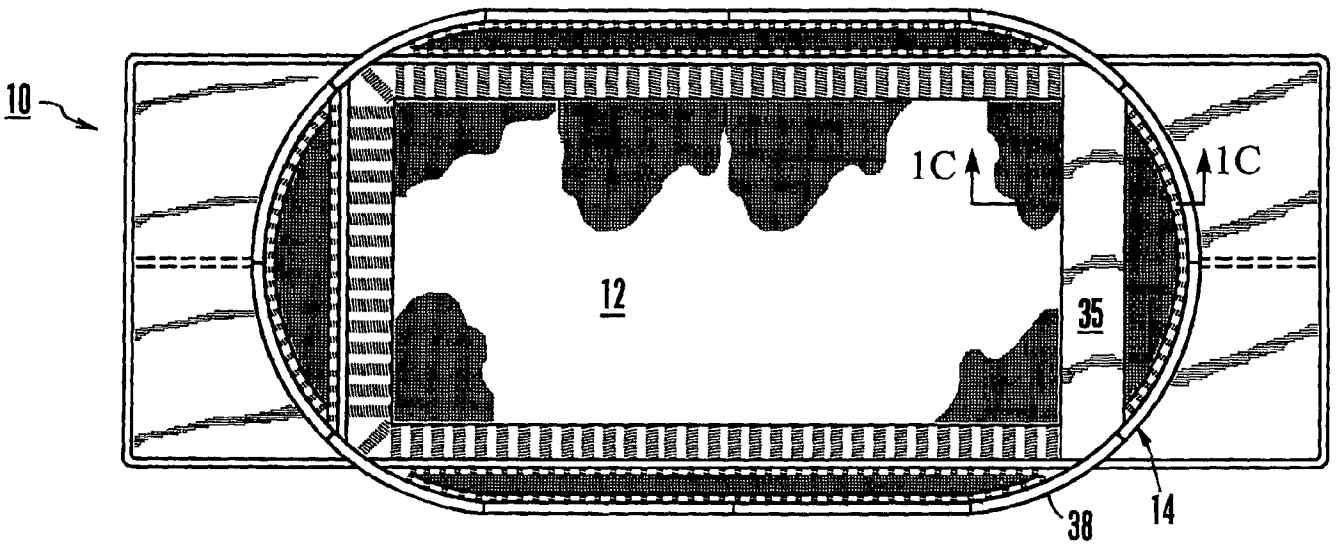
FIG. 1B is a top view of a portion of the trampoline illustrated in FIG. 1A.

FIG. 1B is a top view of the trampoline 10 illustrated in FIG. 1A, with three of the four pads 35 illustrated in FIG. 1A omitted for clarity. As shown in FIG. 1B, the bed 12 is substantially rectangular in shape, while the perimeter region 38 of the base frame 14 is non-rectangular. In this embodiment, the perimeter region 38 has a somewhat oval shape. With this design, the base frame 14 has increased stability over a rectangular base frame because the legs 42 (illustrated in FIG. 1A) are positioned to support the perimeter region 38 of the base frame 14.

Figure 1C:
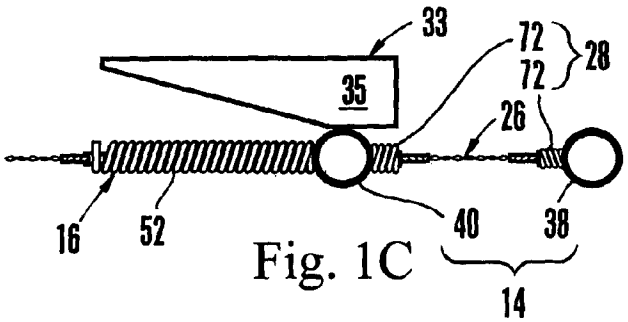
FIG. 1C is a cross-sectional view of the trampoline illustrated in FIG. 1B taken on line C-C.

FIG. 1C is a cross-sectional view of a portion of the trampoline 10 illustrated in FIG. 1B, including the base frame 14, the bed suspension assembly 16, the first end section 26, the first end suspension 28 and the pad assembly 33. In FIG. 1C, the resilient members 72 of the first end suspension 28 secure the first end section 26 to the interior region 40 and the perimeter region 38 of the base frame 14. The pad assembly 33 includes a pad 35 having a somewhat trapezoidal cross-sectional shape, although this shape can vary.

In this embodiment, the portion of the pad 35 adjacent to the resilient member 52 of the bed suspension assembly 16 has a somewhat wedge-shaped cross-section to accommodate the up and down movement of the bed suspension assembly 16 during use of the trampoline 10. Further, the portion of the pad 35 adjacent to the resilient member 72 of the first end suspension 28 has a somewhat rectangular cross-section.

It should be recognized that although the example illustrated in FIG. 1C refers to the first end section 26, this structure can equally be applied to the second end section 30 (illustrated in FIG. 1A), the first side section 18 (illustrated in FIG. 1A), and/or the second side section 22 (illustrated in FIG. 1A), and their respective suspensions 32, 20, 24 (illustrated in FIG. 1A) and/or the pad assembly 33.

Figure 1D:
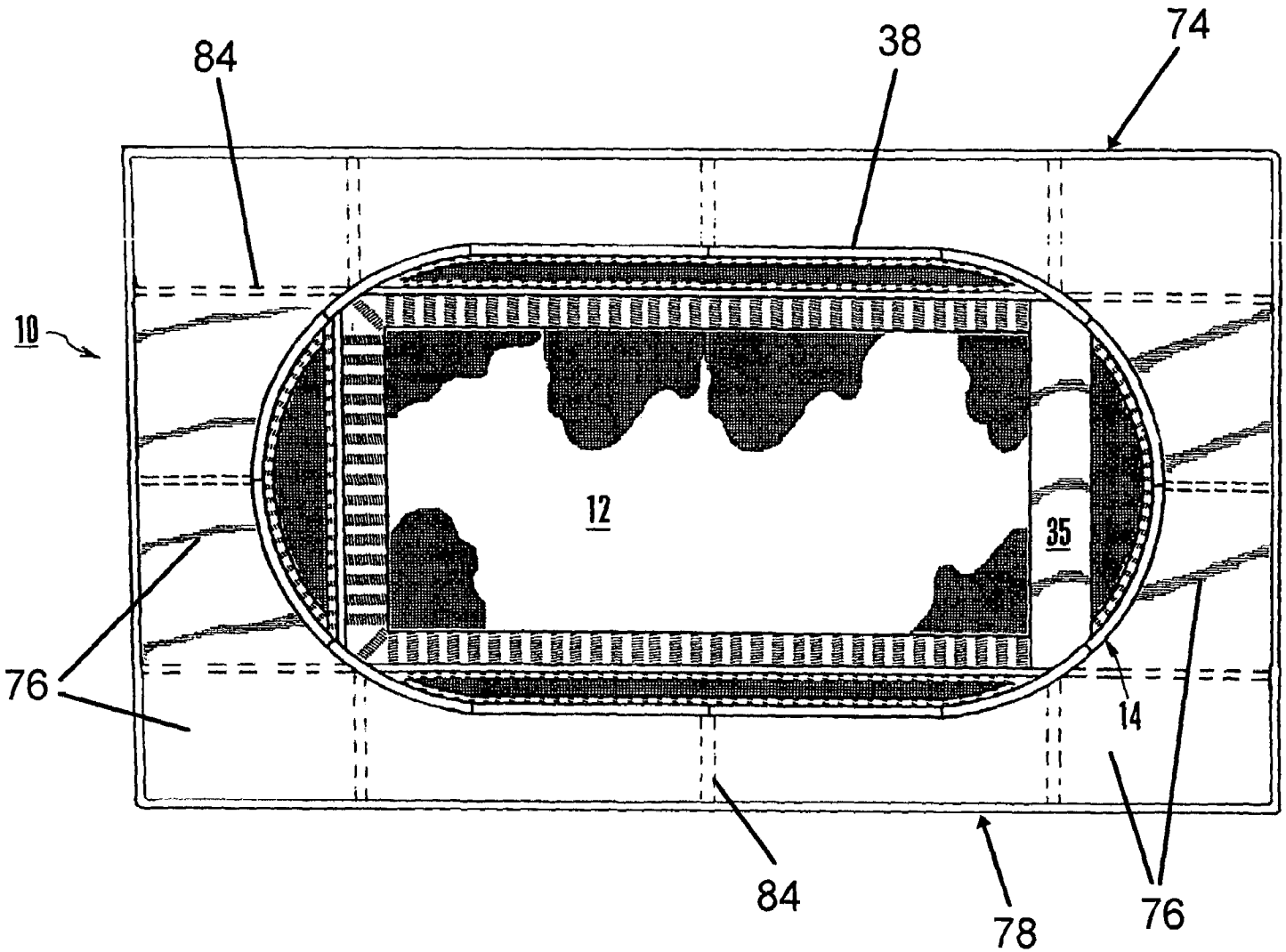
FIG. 1D is a top view of an alternative embodiment of the trampoline.

FIG. 1D is a top view of an alternative embodiment of the trampoline 10 illustrated in FIG. 1A, with three of the four pads 35 omitted for clarity. As shown in FIG. 1D, the bed 12 is substantially rectangular in shape, while the perimeter region 38 of the base frame 14 is non-rectangular. In this embodiment, the perimeter region 38 has a somewhat oval shape. With this design, the base frame 14 has increased stability over a rectangular base frame because the legs 42 (illustrated in FIG. 1A) are positioned to support the perimeter region 38 of the base frame 14.

In the embodiment illustrated in FIG. 1D, the trampoline 10 also includes an extension section 74. In this embodiment, the extension section 74 extends and/or cantilevers from the ends and the sides of the perimeter region 38 of the base frame 14. The extension section 74 has a somewhat rectangular shape, but can have any another suitable configuration. The extension section 74 can include one or more substantially planar platforms 76 and an extension frame 78 that support the platforms 76. The shape and size of the platforms 76 can vary. The platforms 76 can be formed from relatively pliable materials such as canvas, nylon or other soft plastics, or from relatively rigid materials such as wood, metal, or hard plastics, as non-exclusive examples.

Further, in this embodiment, the extension frame 78 includes a plurality of cross-ties 84 (illustrated in phantom) that aid in supporting the platforms 76. The cross-ties 84 increase the rigidity and strength of the extension frame 78.

Figure 2:
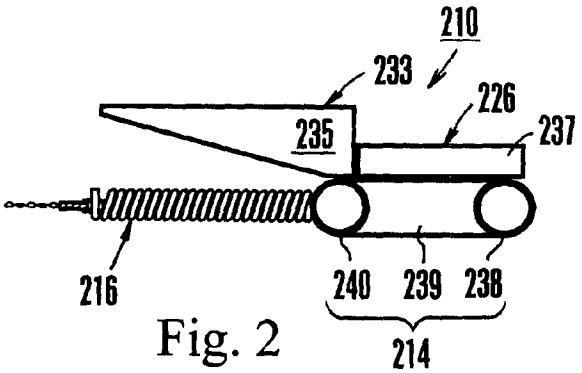
FIG. 2 is a cross-sectional view of another embodiment of a trampoline.

FIG. 2 is a cross-sectional view of an alternative embodiment of a portion of the trampoline 210, including the base frame 214, the bed suspension assembly 216, the first end section 226 and the pad assembly 233. In this embodiment, the first end section 226 includes a substantially rigid end member 237 that is supported by a portion of the base frame 214. The end member 237 can be secured to the base frame 214 by screws or other fasteners (not shown).

The base frame 214 can also include one or more cross-members 239 that support the end member 237. For example, the cross-members 239 can span between the perimeter region 238 and the interior region 240 of the base frame 214. An individual can stand directly on the end member 237 to spot a user during trampolining, or prior to or following trampolining by the individual.

The pad assembly 233 includes one or more pads 235 having a somewhat triangular or trapezoidal cross-sectional shape, although this shape can vary. In this embodiment, the pad 235 does not extend over the first end section 226. However, in an alternative embodiment, the pad 235 can partially or fully cover the first end section 226.

It should be recognized that although the example illustrated in FIG. 2 refers to the first end section 226, this structure can equally be applied to the second end section 30 (illustrated in FIG. 1A), the first side section 18 (illustrated in FIG. 1A) and/or the second side section 22 (illustrated in FIG. 1A), and their respective suspensions 32, 20, 24 (illustrated in FIG. 1A) and/or the pad assembly 33.

Figure 3:
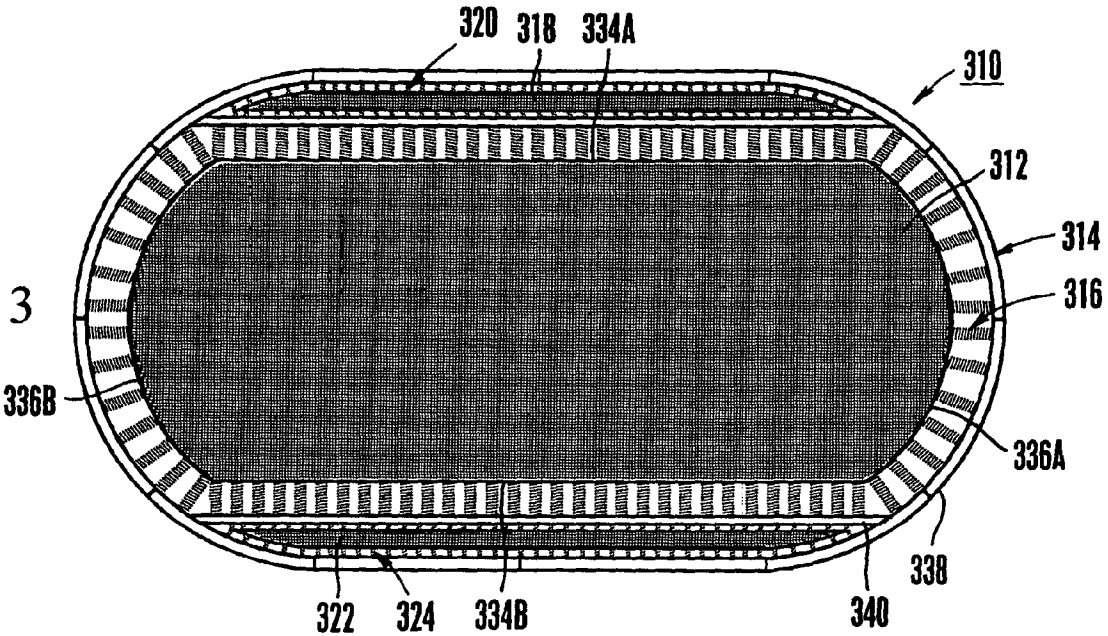
FIG. 3 is a top view of another embodiment of a trampoline having features of the present invention.

FIG. 3 is a top view of another embodiment of the trampoline 310 including the base frame 314, the bed 312 and the bed suspension assembly 316. In this embodiment, the pad assembly has been removed for clarity. The base frame 314 has a substantially similar oval shape to that previously described herein. Further, the bed 312 includes the pair of first sides 334A, 334B that are substantially similar to the first sides 34A, 34B previously described above. In this embodiment, the pair of second sides 336A, 336B includes one or more sides that are substantially arc-shaped. As illustrated in FIG. 3, each second side 336A, 336B can generally follow a contour of a portion of the perimeter region 338 of the base frame 314 that is adjacent to each corresponding second side 336A, 336B.

Further, the bed suspension assembly 316 includes a plurality of resilient members 352 that couple the bed 312 to the base frame 314. For example, the bed suspension assembly 316 illustrated in FIG. 3 includes a plurality of extension springs that couple the first sides 334A, 334B of the bed 312 to the interior region 340 of the base frame 314. In addition, the bed suspension assembly 316 includes a plurality of extension springs that couple the second sides 336A, 336B of the bed 312 to the perimeter region 338 of the base frame 314. Moreover, it is recognized that any of the sides 334A, 334B, 336A, 336B of the bed 312 can be the first sides 334A, 334B or the second sides 336A, 336B.

In this embodiment, the trampoline 310 also includes the first side section 318, the first side suspension 320, the second side section 322 and the second side suspension 324, as previously described above. However, because of the shape of the bed 312, this embodiment does not include first and second end sections and first and second end suspensions. Alternatively, the trampoline 310 can include the first and second end sections (not shown) and the first and second end suspensions (not shown), and omit the first and second side sections 318, 322 and the first and second side suspensions 320, 324.

Figure 4:
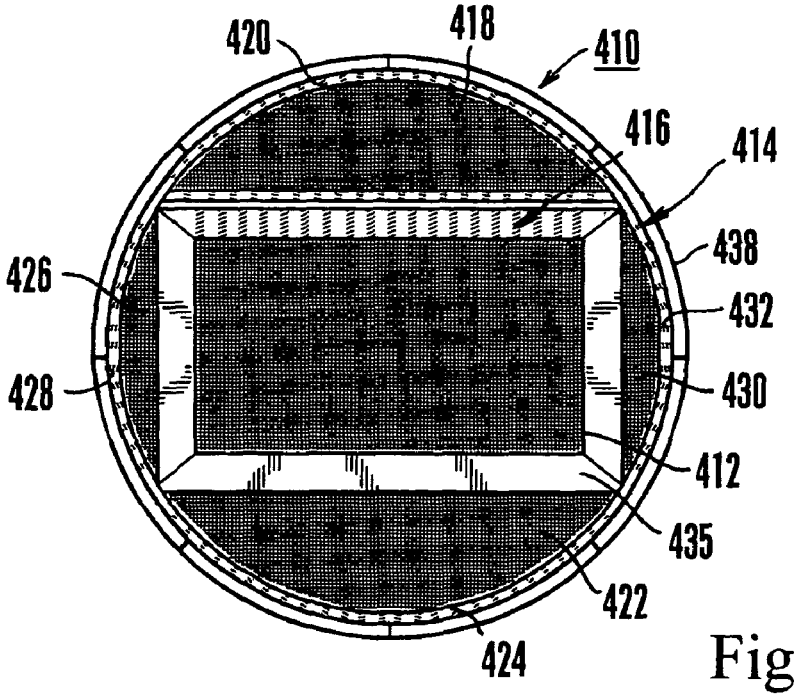
FIG. 4 is a top view of yet another embodiment of the trampoline having features of the present invention.

FIG. 4 is a top view of another embodiment of the trampoline 410, including the base frame 414, the bed 412 and the bed suspension assembly 416. In FIG. 4, one of the pads 435 has been omitted for illustrative purposes. In this embodiment, the perimeter region 438 of the base frame 414 is substantially circular. The dimensions of the base frame 414 can vary to accommodate a specific size of bed 412. The size of the bed 412 can be somewhat smaller than the 14 feet by 7 feet bed that is often used in competition. For example, the bed 412 can have dimensions of 12 feet by 6 feet, or other suitable dimensions depending upon the size of the base frame 414. Alternatively, the bed 412 can be larger than the competition-size bed.

In this embodiment, the trampoline 410 also includes the first and second side sections 418, 422, the first and second side suspensions 420, 424, the first and second end sections 426, 430 and the first and second end suspensions 428, 432, as previously described above.

Figure 5A:
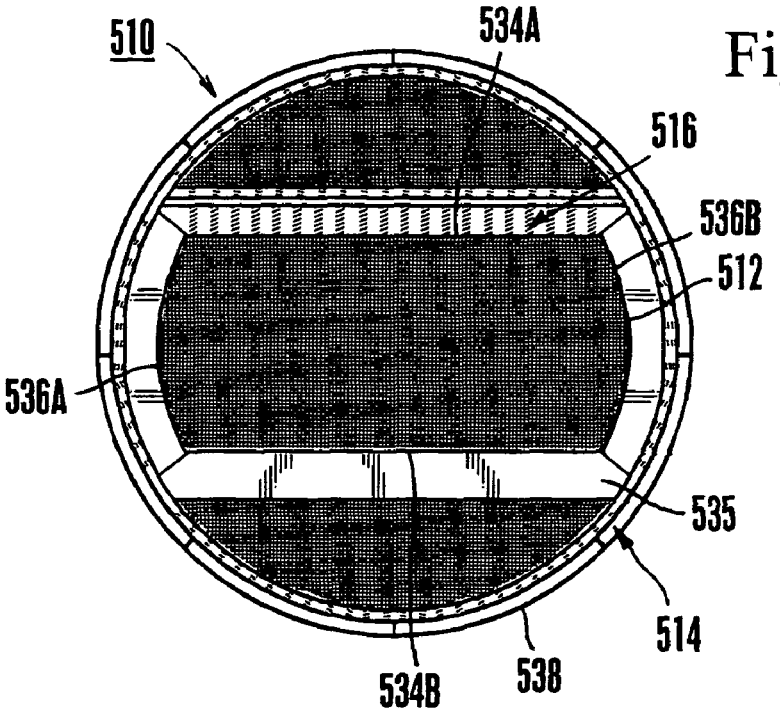
FIG. 5A is a top view of still another embodiment of the trampoline having features of the present invention.

FIG. 5A is a top view of a further embodiment of the trampoline 510, including the bed 512, the base frame 514 and the bed suspension assembly 516. In FIG. 5A, one of the pads 535 has been omitted for illustrative purposes. In this embodiment, the base frame 514 is substantially circular. Further, the bed 512 includes the first sides 534A, 534B that are substantially similar to the first sides 34A, 34B previously described above. The second sides 536A, 536B include one or more sides that are substantially arc-shaped. In this embodiment, the trampoline 510 includes side sections 518, 522 which are similar to those previously described. As illustrated in FIG. 5A, each second side 536A, 536B generally follows a contour of a portion of the perimeter 538 of the base frame 514 that is adjacent to each corresponding second side 536A, 536B.

Figure 5B:
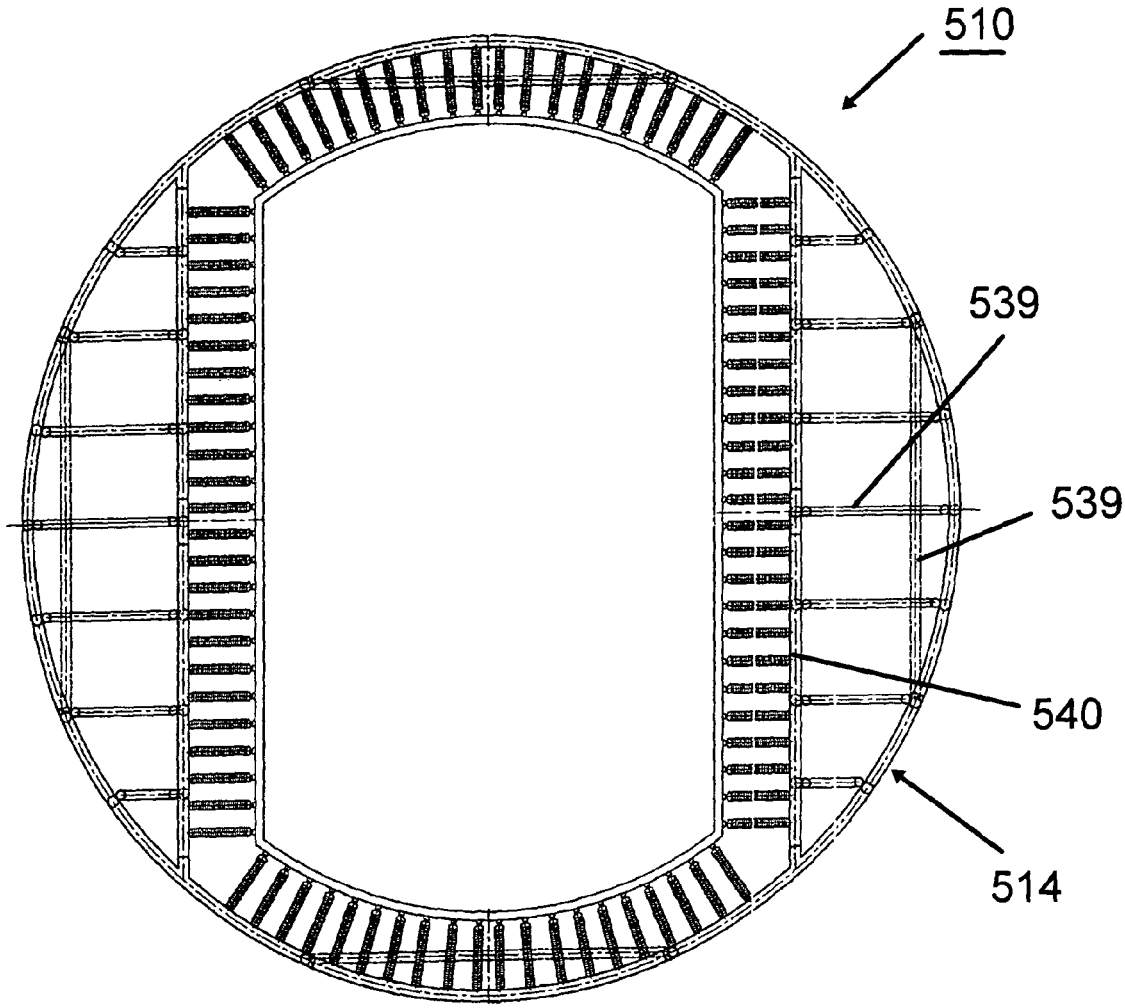
FIG. 5B is a top view of an alternative embodiment of a portion of the trampoline.

FIG. 5B is a top view of an alternative embodiment of the trampoline 510, with the pads 535 (illustrated in FIG. 5A) omitted for clarity. In this embodiment, the side sections (not shown in FIG. 5B) can each include a substantially rigid end member that is supported by a portion of the base frame 514. The end member can be secured to the base frame 514 by screws or other fasteners (not shown). In this embodiment, the base frame 514 includes a plurality of cross-members 539 which support the side sections. The embodiment illustrated in FIG. 5B is representative of one possible configuration of cross-members 539, and is not intended to in any way limit the structure of the base frame 514. Any suitable configuration of cross-members 539 can be used provided the requisite support strength is achieved. Moreover, the cross-members 539 can inhibit any unwanted bending or flexing of the interior region 540 and/or other portions of the base frame 514.

Figure 6:
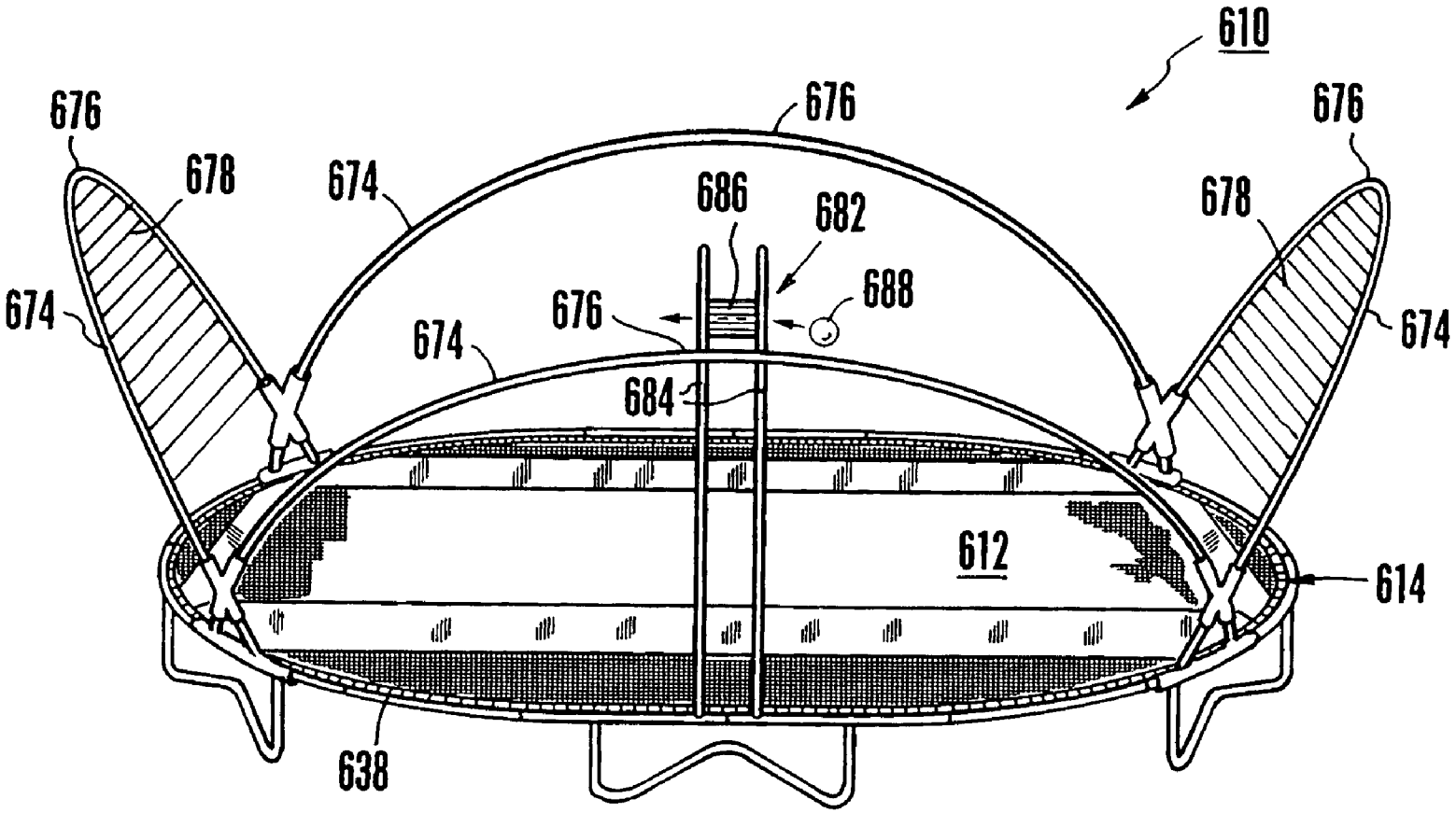
FIG. 6 is a perspective view of another embodiment of the trampoline having features of the present invention.

FIG. 6 is a perspective view of another embodiment of the trampoline 610. In this embodiment, the trampoline 610 includes an attachment having four substantially arch-shaped backstop frames 674. An example of a suitable attachment for the trampoline 610 is provided in U.S. Pat. No. 6,135,922, issued to Nissen. To the extent permitted, the disclosure of U.S. Pat. No. 6,135,922 is incorporated herein by reference.

The backstop frames 674 for the attachment are mounted to the base frame 14. Specifically, the backstop frames 674 are mounted on the base frame 614 to project upwards from the base frame 614. Further, each backstop frame 674 projects slightly outward radially from the center of the bed 612, so that an apex 676 of each backstop frame 674 is substantially directly above the base frame 614, as shown in FIG. 6.

In this embodiment, the backstop frames 674 can also be attached to each other. With this configuration, a more sturdy structure is formed. The attachment can also include up to four backstop beds 678 (only two backstop beds 678 are illustrated for clarity). Each backstop bed 678 is attached to a backstop frame 674 with a backstop suspension assembly (not shown). With this configuration, a trampoline-like effect is created in each of the backstop beds 678. If the trampoline user rebounds against any of the backstop beds 678, the bed 678 reacts against the user and directs the user back towards the center of the bed 612. In one embodiment, one of the backstop beds 678 is omitted or made from a see-through netting material to allow for better spectator vision, coaching, and supervision.

In the embodiment illustrated in FIG. 6, the trampoline 610 includes a center gantry 682 that configures the trampoline 610 for a game of spaceball. The center gantry 682 has two substantially arch-shaped center frames 684 spaced about two feet apart and one or more center nettings 686 that are formed with openings for passing a spaceball 688 through. The center netting 686 is attached to the center frames 684 with a center suspension assembly (not shown).

As shown in FIG. 6, the center frames 684 are mounted to the perimeter region 638 of the base frame 614. These center frames 684 project substantially perpendicularly from the perimeter region 638 of the base frame 614, and the openings of the center frames 684 are connected with fabric to establish a chute (not shown).

The trampolines 10 described herein have one or more of the following advantages: the substantially round base frame 14 eliminates the need for a standard rectangular base frame that is positioned at least partially under the bed 12, and thus can result in lowering the bed 12 closer to the support surface 44. The base frame 14 provided herein can make use of existing modular economic features of the round base frame 14 in fabricating, storing, assembling and/or shipping. The trampoline 10 can result in taking up approximately the same amount of space as a conventional round trampoline. One or more of the beds 12 provided herein have many or all of the same performance advantages of a conventional, rectangular bed on a rectangular base frame. One or more of the trampolines described herein provide substantially flat side and end sections 18, 22, 26, 30 between the perimeter region 38 and the interior region 40 of the base frame 14, which allow participants to get on and off the trampoline bed 12 more efficiently and easily. These sections 18, 22, 26, 30 are conducive to standing, coaching, spotting and/or controlling accessibility to the bed 12 of the trampoline 10.

While the particular trampoline 10 as herein shown and disclosed in detail is fully capable of obtaining the objects and providing the advantages herein before stated, it is to be understood that it is merely illustrative of some of the presently preferred embodiments of the invention and that no limitations are intended to the details of construction or design herein shown other than as described in the appended claims.

What is claimed is:

1. A trampoline comprising:

a bed having a pair of substantially parallel first sides;

a base frame having a substantially non-rectangular perimeter region frame, an interior region frame and a plurality of legs that are coupled to the perimeter region frame and that support the perimeter region frame above a support surface, wherein at least approximately 25 percent of the total length of the perimeter region frame is curved; wherein the perimeter region frame encircles the interior region frame, and wherein the interior region frame is positioned substantially between and at least partly spaced apart from the perimeter region frame and the bed; and a bed suspension assembly that includes a plurality of resilient members, the bed suspension assembly attaching the bed to the base frame with the bed in tension.

2. The trampoline of claim 1 wherein the bed includes a pair of substantially parallel second sides.

3. The trampoline of claim 1 wherein the bed includes a pair of second sides, each second side being substantially arc-shaped.

4. The trampoline of claim 1 wherein the perimeter region of the base frame is substantially oval-shaped.

5. The trampoline of claim 1 wherein the perimeter region frame of the base frame is substantially circular-shaped.

6. The trampoline of claim 1 further comprising a first side section and a first side suspension that couples the first side section to the base frame, the first side section having a first inner side that is substantially linear and a first outer side that is substantially arc-shaped, the first side suspension and the first side section cooperating to connect the perimeter region frame to the interior region frame.

7. The trampoline of claim 6 further comprising a second side section and a second side suspension that couples the second side section to the base frame, the second side section having a second inner side that is substantially linear and a second outer side that is substantially arc-shaped, wherein the bed is positioned substantially between the first side section and the second side section, the second side suspension and the second side section cooperating to connect the perimeter region frame to the interior region frame.

8. The trampoline of claim 7 wherein the first side suspension includes a plurality of resilient members that support the first side section, and the second side suspension includes a plurality of resilient members that support the second side section.

9. The trampoline of claim 8 wherein the first inner side of the first side section and the second inner side of the second side section are each substantially parallel to the first pair of sides of the bed.

10. The trampoline of claim 8 further comprising a first end section, a first end suspension that couples the first end section to the base frame, a second end section and a second end suspension that couples the second end section to the base frame, the first end section having a first inner side that is substantially linear and a first outer side that is substantially arc-shaped, and the second end section having a second inner side that is substantially linear and a second outer side that substantially arc-shaped.

11. The trampoline of claim 10 wherein the first end suspension includes a plurality of resilient members that support the first end section, and the second end suspension includes a plurality of resilient members that support the second end section.

12. The trampoline of claim 1 wherein the bed is substantially rectangular-shaped.

13. The trampoline of claim 1 further comprising a substantially horizontal first end region that extends away from the perimeter region of the base frame in a direction away from the bed.

14. The trampoline of claim 13 further comprising a substantially horizontal second end region that extends from the perimeter region of the base frame in a direction away from the bed, wherein the bed is positioned directly between the first end region and the second end region.

15. The trampoline of claim 1 further comprising an attachment including a plurality of arc-shaped, backstop frames that are mounted to the base frame, wherein (i) an apex of each backstop frame is positioned above the base frame, (ii) the apex of each backstop frame is spaced apart from the apex of each of the other backstop frames, and (iii) each backstop frame is connected to at least one of the other backstop frames.

16. A trampoline comprising:

a base frame having a substantially planar perimeter region frame that includes at least one arc-shaped section, and an interior region frame that is at least partly spaced apart from the perimeter region frame, the perimeter region frame substantially encircling the interior region frame;

a bed suspension assembly;

a bed that is coupled to the base frame with the bed suspension assembly, the bed having a pair of substantially parallel first sides;

a first side section having a first inner side that is substantially linear and a first outer side that substantially follows a contour of a portion of one of the arc-shaped sections of the perimeter region frame, the first inner side being substantially parallel to the pair of first sides of the bed;

a first side suspension that couples the first side section to the base frame;

a second side section having a second inner side that is substantially linear and a second outer side that substantially follows a contour of a portion of one of the arc-shaped sections of the perimeter region, the second inner side of the second side section being substantially parallel to the pair of first sides of the bed; and a second side suspension that couples the second side section to the base frame.

17. The trampoline of claim 16 further comprising (i) a first end section having a first inner side that is substantially linear and a second outer side that substantially follows a contour of a portion of one of the arc-shaped sections of the perimeter region, (ii) a first end suspension that couples the first end section to the base frame, (iii) a second end section having a second inner side that is substantially linear and a second outer side that substantially follows a contour of a portion of one of the arc-shaped sections of the perimeter region, and (iv) a second end suspension that couples the second end section to the base frame.

18. A trampoline for use on a support surface, the trampoline comprising:

a trampoline bed that includes a pair of substantially parallel sides;

a base frame having a substantially non-rectangular perimeter region frame, an interior region frame and a plurality of legs that are coupled to the base frame and that support the base frame above the support surface; wherein the perimeter region frame encircles the interior region frame, and wherein the interior region frame is positioned substantially between and at least partly spaced apart from the perimeter region frame and the bed; and a bed suspension assembly that includes a plurality of resilient members that attach the bed to the base frame to place the bed in tension.

19. The trampoline of claim 18 wherein the interior region frame includes a pair of generally straight sides.

20. The trampoline of claim 18 further comprising a first side section and a first side suspension that cooperate to connect the perimeter region frame to the interior region frame.

21. A method for manufacturing a trampoline, the method comprising the steps of:

providing a bed having a pair of substantially parallel first sides;

providing a base frame having a substantially non-rectangular perimeter region frame, an interior region frame, and a plurality of legs that are coupled to the perimeter region frame and that support the perimeter region frame above a support surface, wherein at least approximately 25 percent of the total length of the perimeter region frame is curved, wherein the interior region frame is positioned substantially between and at least partly spaced apart from the perimeter region frame and the bed; and wherein the perimeter region frame substantially encircles the interior region frame; and coupling the bed to the base frame with a bed suspension assembly, the bed suspension assembly including a plurality of resilient members that extend between the base frame and the bed.

22. The method of claim 21 wherein the step of providing a base frame includes providing a base frame with a continuously curved perimeter.

23. The method of claim 22 further comprising the steps of (i) providing a first side section having a first inner side that is substantially linear and a first outer side that substantially follows a contour of a portion of the perimeter region, the first inner side being substantially parallel to the pair of first sides of the bed, (ii) coupling the first side section to the base frame with a first side suspension, (iii) providing a second side section having a second inner side that is substantially linear and a second outer side that substantially follows a contour of a portion of the perimeter region, the second inner side being substantially parallel to the pair of first sides of the bed, and (iv) coupling the second side section to the base frame with a second side suspension.

24. A method for manufacturing a trampoline, the method comprising the steps of:

providing a base frame having a continuously curved perimeter region and a plurality of legs that are coupled to the perimeter region and that support the perimeter region above a support surface; and coupling a bed having a pair of substantially parallel first sides to the base frame with a bed suspension assembly, the bed suspension assembly including plurality of resilient members that extend between the base frame and the bed;

providing a first side section having a first inner side that is substantially linear and a first outer side that substantially follows a contour of a portion of the perimeter region, the first inner side being substantially parallel to the pair of first sides of the bed;

coupling the first side section to the base frame with a first side suspension;

providing a second side section having a second inner side that is substantially linear and a second outer side that substantially follows a contour of a portion of the perimeter region, the second inner side being substantially parallel to the pair of first sides of the bed; and coupling the second side section to the base frame with a second side suspension.

* * * * *